US008556031B1

(12) United States Patent
Arnal et al.

(10) Patent No.: US 8,556,031 B1
(45) Date of Patent: Oct. 15, 2013

(54) TETHER DEVICE AND RELATED METHODS

(75) Inventors: David B. Arnal, Mount Laurel, NJ (US); Timothy T. Broderick, Voorhees, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 561 days.

(21) Appl. No.: 12/402,002

(22) Filed: Mar. 11, 2009

Related U.S. Application Data

(63) Continuation-in-part of application No. 12/335,958, filed on Dec. 16, 2008, now abandoned.

(51) Int. Cl.
*A62B 35/00* (2006.01)

(52) U.S. Cl.
USPC ..... 182/3; 135/66

(58) Field of Classification Search
USPC ..... 182/3; 248/206.5, 125.8, 683; 294/19.1
See application file for complete search history.

(56) References Cited

U.S. PATENT DOCUMENTS

| | | | | |
|---|---|---|---|---|
| 3,952,695 | A * | 4/1976 | Vollstedt | 116/173 |
| 4,144,833 | A * | 3/1979 | Newman, Sr. | 116/28 R |
| 5,388,546 | A | 2/1995 | Lombard | |
| 5,746,329 | A | 5/1998 | Rondeau | |
| 6,042,080 | A * | 3/2000 | Shepherd et al. | 248/683 |
| 6,065,787 | A * | 5/2000 | Jarosch | 294/19.1 |
| 7,367,347 | B2 * | 5/2008 | Field | 135/66 |

* cited by examiner

*Primary Examiner* — Blair M. Johnson
(74) *Attorney, Agent, or Firm* — Howard IP Law Group, PC

(57) ABSTRACT

A tether device includes a magnetic base; a pole having a first end attached to the magnetic base; and a connector or clip attached at a second end of the pole, for removably connecting the tethering device to a user. Also, a method for tethering a user to a hull of a vessel including the steps of providing a tether device having a magnetic base, a pole having a first end attached to the magnetic base, and a connector or clip attached at a second end of the pole; connecting the connector or clip to the user; and engaging the magnetic base with the hull of the vessel.

16 Claims, 4 Drawing Sheets

TETHER DEVICE AND RELATED METHODS

GOVERNMENTAL INTEREST

This invention was made with Government support under Contract No. N00024-03-C-5115 awarded by the Department of the Navy. The Government has certain rights in this invention.

FIELD OF INVENTION

The present invention relates to a tether device. More particularly, the present invention relates to a tether device and method for tethering a user to a hull of a vessel to enable a user to draw him- or herself toward the inward sloping portions of the vessel's hull to perform painting and other maintenance and repair tasks.

BACKGROUND OF THE INVENTION

When ships and other vessels are floating in water and the hull of the vessel requires painting and/or other maintenance and repairs, a maintenance person must be lowered over the side of the vessel in a support harness to access the exterior side surface of the hull to perform the service. Some portions of the hull slope inward from the point of suspension. To reach these areas, a secondary support must be used to draw the maintenance person close enough to the inward sloping portions of the hull to perform the task.

Permanently welded clips are provided on the hulls of vessels where tethering is required to perform painting and/or other hull maintenance and repairs. The clips are accessed by the maintenance person using a grappling hook. The person then sequentially hooks on and off the clips to move along the hull. This requires a great deal of manual dexterity and increases safety risk during these maneuvers.

The use of welded clips has several disadvantages. The vessel's hull is weakened by the clip welding process due to heating. The discontinuities on the exterior surface of the hull promote corrosion because the paint film is less durable in these areas. Many ships and vessels have in excess of 100 clips welded to the exterior surface of the hull.

Accordingly, a device and/or method is needed that allows the elimination of the welded clips.

SUMMARY

Disclosed herein is a tether device comprising: a magnetic base; a pole having a first end attached to the magnetic base; and a connector or clip attached at a second end of the pole, the connector or clip for removably connecting the tethering device to a user.

Also disclosed herein is a method for tethering a user to a hull of a vessel. The method comprises the steps of: providing a tether device comprising a magnetic base, a pole having a first end attached to the magnetic base, and a connector or clip attached at a second end of the pole; connecting the connector or clip to the user; and engaging the magnetic base with the hull of the vessel.

DETAILED DESCRIPTION OF THE INVENTION

Figure 1:
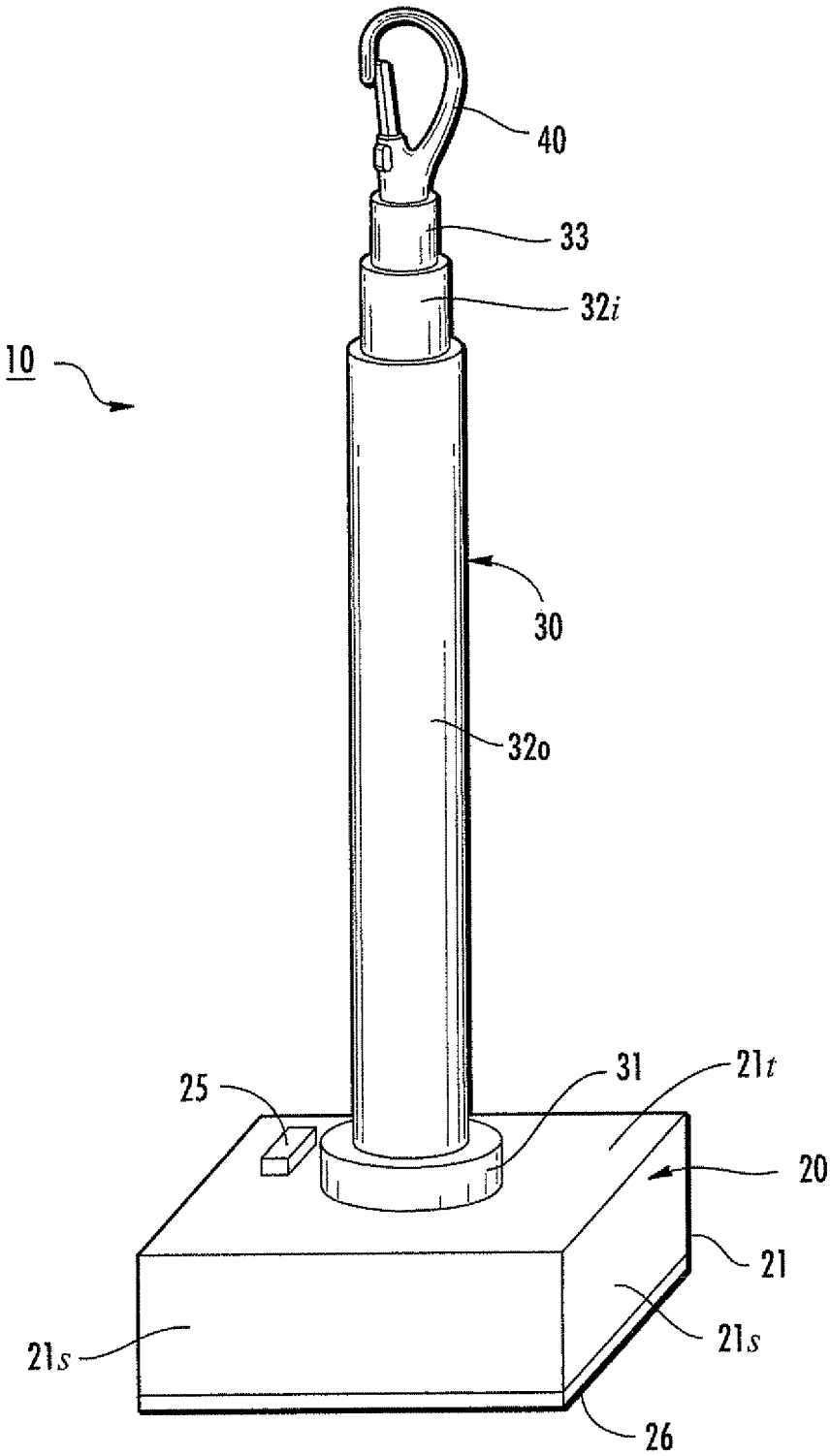
FIG. 1 shows a perspective view of an embodiment of a tether device.
Figure 3:
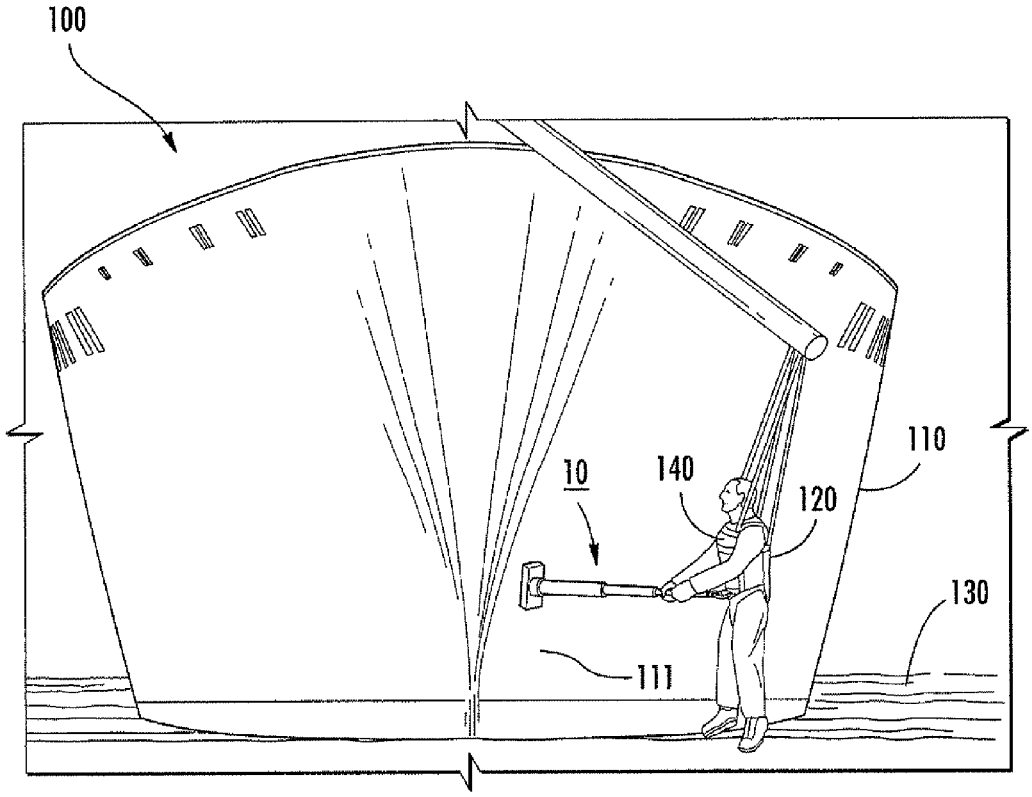
FIG. 3 shows a pictorial representation of the tether device in operation for tethering a user to a hull of a vessel.

FIG. 1 is a perspective view of an embodiment of a tether device 10 for tethering a maintenance person or other user to a hull 110 of a vessel 100. The tether device 10 enables the user to draw him- or herself toward the inward sloping portions of the vessel's hull 110 to perform painting and other maintenance and repair tasks while the vessel 100 is floating on water. In addition, the hull clips which negatively impact the hull of the vessel over the lifecycle of the vessel, may be deleted when the tether device 10 is utilized. The tether device 10 generally comprises a magnetic base 20, a lightweight, elongated tethering pole 30 extending away from the base 20, and a connector or clip 40 disposed at a free end of the pole 30. The magnetic base 20 of the tether device 10 allows it to be magnetically attached to the hull 110 of the floating vessel 100 (FIG. 3). The vessel 100 may include, without limitation, a naval ship, a tanker, a bulk carrier, a container ship as well as a towed or pushed barge.

Figure 2:
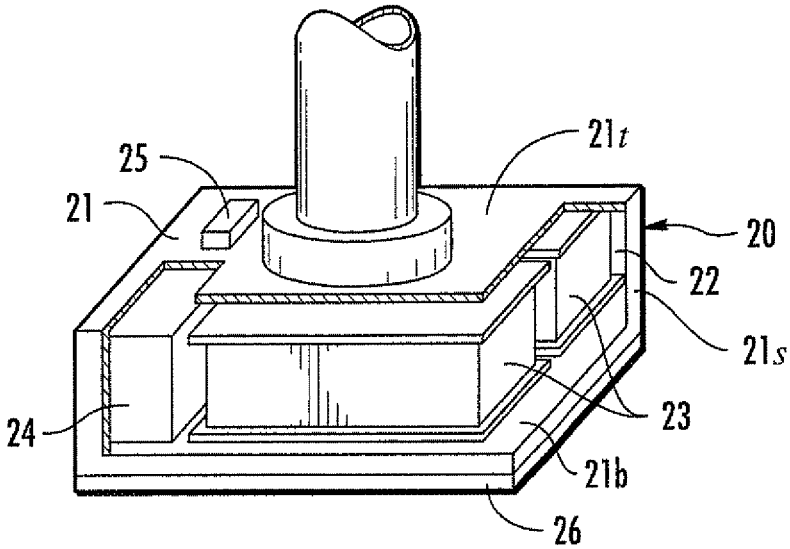
FIG. 2 shows a cut away view of the magnetic base of the tether device.

In one embodiment, as shown in FIG. 2, the magnetic base 20 comprises a housing 21 and one or more electromagnets 23 disposed within the housing 21. The housing 21 includes a top wall 211, at least one side wall 21*s* depending from the top wall, and a bottom wall 21*b*. The top and side walls 21*t*, 21*s* of the housing 21 form an internal compartment 22 for containing the one or more electromagnets 23. The electromagnets 23 are powered by a power source. In one embodiment, the power source may comprise a battery 24 disposed in the internal compartment of the housing 21 with the electromagnets 23. In an alternative embodiment, the power source may comprise an alternating current source. The current source may be obtained from the vessel with suitable electrical power isolation to preclude a shock hazard. A switch arrangement 25 may be provided for allowing a user to selectively connect and disconnect the power source to and from the electromagnets 23 to respectively activate and deactivate of the magnetic base 20. A protective covering 26 may be disposed on the bottom wall 21*b* to protect the exterior surface of the vessel's hull from damage when the tether device 10, is placed thereon. The protective covering 26 may be of any suitable material for preventing marring of a hull's exterior surface. Examples of such materials include, without limitation, felt or other fabrics, plastic, natural or synthetic rubbers, and polymeric foams. In a preferred embodiment, the protective covering 26 comprises the natural or synthetic rubber mentioned earlier because it provides a high degree of friction to prevent sliding.

When activated by the switch arrangement 25, the one or more electromagnets 23 should have sufficient magnetic strength to retain the tether device 10 to the hull 110 of the floating vessel 100, when tethering the user thereto.

Figure 4:
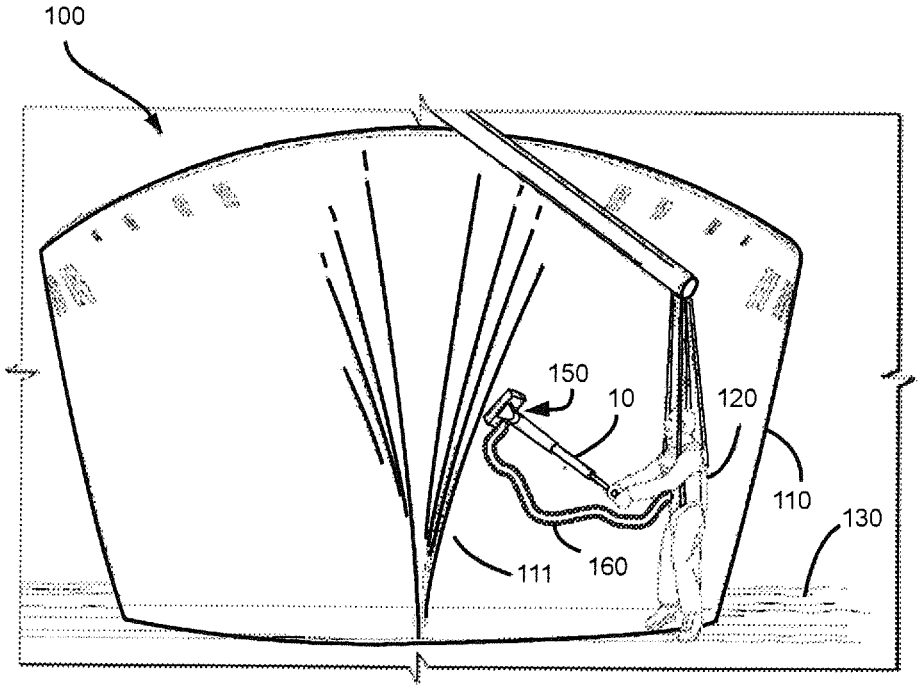
FIG. 4 shows a pictorial representation of an embodiment of a tether device according to the application in operation for tethering a person to the hull of a vessel.

Referring again to FIG. 1, the tethering pole 30 is capable of being telescopically extended and collapsed to provide a variable adjustable length to suit stand off distance requirements. In one embodiment, the telescopically adjustable tethering pole 30 comprises a mount 31 fixedly attached (e.g., welded, riveted, screw-fastened, etc.) to the top wall 21*t* of the magnetic base housing 21, two or more telescopically engaged tubes 32*o* and 32*i*, the outer tube 32*o* of which is fixedly connected or pivotally connected (e.g. a ball and socket or like arrangement 150 as shown in FIG. 4) to the mount 31, and a solid rod 33 telescopically disposed within the inner tube 32*i*. The pole 30 may be adapted and dimensioned to provide friction between the outer and inner tubes 32*o* and 32*i* and between the solid rod 33 and inner tube 32*i* to maintain the length of the pole 30, once it has been extended or collapsed to a desired length. Alternatively, the pole 30 may include internal locking rings such as those found on photographic tripods, to maintain the length of the pole 30, once it has been extended or collapsed to a desired length. The outer tube 32*o* may be fixedly connected to the mount 312 using any suitable method. For example, one or more set screws may be used for fixedly connecting the outer tube 32*o* to the mount 31, or the outer tube 32*o* may be threaded into the mount 31. The outer tube 32*o* may also be pivotally connected to the mount 31 using any suitable method. For example, a ball and socket (ball-joint) arrangement (150, shown in FIG. 4) may be used for pivotally connecting the outer tube 32*o* to the mount 31. The connector or clip 40 may be fixedly attached to a free end portion of the rod 33. The connector or clip may comprises a quick release hook or, in another embodiment, a solid loop and a carabiner to allow for attachment and release.

As shown in FIG. 3, the tether device 10 allows a user 120 to draw him- or herself toward the inward sloping portions 111 of the vessel's hull 110 to perform painting and other maintenance and repair tasks while the vessel 100 is floating on water 130. The tether device 10 may also be used to work on non-sloped sections of the vessel's hull 110. In one embodiment, the user 120 attaches the connector or clip 40 of the tether device 10 to the user's suspension harness, clothing, footwear, helmet, belt, and other articles worn (denoted generally by reference numeral 140) by the user 120. After the connector or clip 40 has been attached to the user 120, the user 120 is lowered over the side of the floating vessel 100, adjacent to the sloped section 111 of the hull 110 of the floating vessel 100. The user 120 then activates the electromagnets 23 of the magnetic base 20, by way of a switch arrangement 25, and extends the tethering pole 30, to attach the tether device 10, via the magnetic base 20 to the sloped section 111 of the hull 110 at a selected location thereof, and pulls himself or herself toward the hull 110 of the vessel 100 by collapsing the tethering pole 30 and locking the pole 30 to the desired length. Once the tether pole 30 is collapsed, the user 120 may attach a strap (160, shown in FIG. 4) to the magnetic base 20 and disconnect the tethering pole 30 to allow for greater freedom of movement while performing tasks.

When work at that location of the vessel 100 is completed, the user 120 deactivates the electromagnets 23 of the base 20, via the switch arrangement 25, thereby releasing the magnetic base 20 and thus the tether device 10 from the hull 110 of the vessel 100. If desired, the user 120 can then relocate the magnetic base 20 of the tether device 10 to another location of the hull 110 and repeat the procedure described immediately above. Once work on the vessel 100 has been completed and the user 120 is back on the vessel 100 or dock, the connector or clip 40 may be disconnected from the user's suspension harness, clothing, belt, footwear, helmet, and other worn article 140.

In an alternate embodiment, the electro-magnets may be replaced by one or more permanent magnets. As in the previous embodiment, the one or more permanent magnets should have sufficient magnetic strength to retain the tether device on the hull of the floating vessel, when tethering the user thereto. In this embodiment, magnetic base of the tethering device may be attached and released from the hull of the floating vessel thru mechanical leverage.

In another alternate embodiment, the tethering pole may comprise a single tube instead of the two or more telescopically engaged tubes as previously described. The single tube may be fixedly or pivotally connected to the mount, and a solid rod with a connector or clip fixedly attached to a free end portion thereof, may be telescopically disposed within the tube.

The tethering pole, in still another alternate embodiment, may comprise a fixed length, solid shaft. A first end of the shaft may be fixedly or pivotally connected to the top wall of the magnetic base housing. The connector or clip may be fixedly attached to the free end portion of the rod.

While the foregoing invention has been described with reference to the above, various modifications and changes can be made without departing from the spirit of the invention. Accordingly, all such modifications and changes are considered to be within the scope of the appended claims.

What is claimed is:

1. A device for tethering a person to a hull of a ship comprising:

a magnetic base;

a pole having a first end attached to the magnetic base;

a connector or clip attached at a second end of the pole, the connector or clip configured to removably connect the device to the person; and an article for wearing by a person, said article configured to be removably coupled to said connector or clip;

wherein said magnetic base is configured to be magnetically attached to the hull of the ship, and to be retained on the hull to tether the person to the hull when the person is connected via the connector or clip to the pole and the magnetic base.

2. The device of claim 1, wherein the magnetic base includes one or more electromagnets.

3. The device of claim 1, wherein the pole is capable of telescopically extending and collapsing.

4. The device of claim 3, wherein the pole includes a tube and a rod telescopically disposed within the tube.

5. The device of claim 4, wherein the tube comprises a first tube, the pole further including at least a second tube telescopically engaged with the first tube.

6. The device of claim 1, wherein the pole includes a tube and a rod telescopically disposed within the tube.

7. The device of claim 1, wherein the pole includes at least two tubes and a rod telescopically engaged with one another.

8. The device of claim 1, wherein said connector or clip comprises a loop assembly.

9. The device of claim 8, wherein said loop assembly comprises a quick release hook.

10. The device of claim 1, wherein said first end of said pole is pivotally attached to said magnetic base.

11. The device of claim 1, wherein said article is a harness.

12. The device of claim 1, wherein the pole is adapted to provide a selected stand-off distance between the person and the magnetic base.

13. A device for tethering a person to a hull of a ship comprising:

a magnetic base;

a pole having a first end attached to the magnetic base;

a connector or clip attached at a second end of the pole, the connector or clip configured to removably connect the device to the person; and a strap;

wherein said magnetic base is configured to be magnetically attached to the hull of the ship, and to be retained on the hull to tether the person to the hull when the person is connected via the connector or clip to the pole and the magnetic base; and wherein the strap is adapted to be coupled between the person and the magnetic base, thereby allowing the person to move about the magnetic base in an area having a diameter defined by a length of the strap, without requiring the person to remain attached to the pole.

14. The device of claim 13, wherein the magnetic base includes one or more electromagnets.

15. The device of claim 13, wherein the pole is capable of telescopically extending and collapsing.

16. A device for tethering a person to a hull of a vessel, the device comprising:

a base defining a housing;

at least one electromagnet disposed in said housing;

a power source within said housing for activating said at least one magnet;

a rubber covering on a first surface of said housing for protecting the hull of the vessel;

a pole having a first end connected to said base, said pole comprising a plurality of tubes, telescopically engaged with one another, and having frictional engagement between the tubes to maintain a desired length of the pole after adjustment by the person to permit the person to draw himself or herself toward the hull via the pole;

a switch coupled to said power source and said at least one magnet, said switch mounted on a second surface of said housing, wherein said pole is connected to said base at said second surface the switch allowing the person to activate and deactivate the at least one electromagnet when the person is attached to said device;

a connector or clip attached to a second end of said pole for attaching to an article for wearing by the person; and a strap attachable to said base at a first end, and to the person at a second end;

wherein said at least one electromagnet has a sufficient magnetic strength to retain the base to the hull of the ship when tethering the person thereto.

* * * * *